US005888096A

United States Patent [19]

Soes et al.

[11] Patent Number: 5,888,096

[45] Date of Patent: Mar. 30, 1999

[54] ELECTRICAL CONNECTOR, HOUSING AND CONTACT

[75] Inventors: Lucas Soes; Johannes Marinus Jacobus Den Otter, both of Rosmalen; Willem Reginald Maria Smits, Oss; Jan Hendrik Ate Wiekamp, PM's-Hertogenbosch, all of Netherlands

[73] Assignee: The Whitaker Corporation, Wilmington, Del.

[21] Appl. No.: 676,368

[22] PCT Filed: Jan. 18, 1995

[86] PCT No.: PCT/IB95/00035

§ 371 Date: Jul. 17, 1996

§ 102(e) Date: Jul. 17, 1996

[87] PCT Pub. No.: WO95/20252

PCT Pub. Date: Jul. 27, 1995

[30] Foreign Application Priority Data

| | | | |
|---|---|---|---|
| Jan. 25, 1994 | [GB] | United Kingdom | 9401336 |
| Feb. 16, 1994 | [GB] | United Kingdom | 9402907 |
| Feb. 16, 1994 | [GB] | United Kingdom | 9402981 |
| Jun. 6, 1994 | [GB] | United Kingdom | 9411276 |
| Aug. 11, 1994 | [GB] | United Kingdom | 9416239 |

[51] Int. Cl.[6] ..... H01R 9/03

[52] U.S. Cl. ..... 439/610; 439/252; 439/857

[58] Field of Search ..... 439/246, 252, 439/608, 610; 29/876, 883

[56] References Cited

U.S. PATENT DOCUMENTS

| | | | |
|---|---|---|---|
| 3,491,441 | 1/1970 | Belsaas | 29/629 |
| 4,506,940 | 3/1985 | Asick et al. . | |
| 4,585,292 | 4/1986 | Frantz et al. | 439/736 X |
| 4,602,830 | 7/1986 | Lockard | 449/14 R |
| 4,605,276 | 8/1986 | Rasircoglu . | |
| 4,744,769 | 5/1988 | Grabbe et al. | 439/610 X |
| 4,773,881 | 9/1988 | Adams, III | 439/681 |
| 4,778,404 | 10/1988 | Pass | 439/246 X |
| 4,867,707 | 9/1989 | Widdoes | 439/675 |
| 4,984,992 | 1/1991 | Beamenderfer et al. | 439/108 |
| 5,009,614 | 4/1991 | Fogg et al. | 439/497 |
| 5,009,616 | 4/1991 | Fogg et al. | 439/608 |
| 5,041,020 | 8/1991 | Michael | 439/578 |
| 5,085,596 | 2/1992 | Bowen et al. | 439/608 X |
| 5,090,920 | 2/1992 | Casey | 439/540 |
| 5,108,317 | 4/1992 | Beinhaur et al. | 439/736 |
| 5,122,066 | 6/1992 | Plossmer | 439/246 X |
| 5,312,276 | 5/1994 | Hnatuck et al. | 439/681 |
| 5,611,717 | 3/1997 | Joly | 439/252 X |

FOREIGN PATENT DOCUMENTS

| | | |
|---|---|---|
| 0 112 019-A1 | 6/1983 | European Pat. Off. . |
| 0 412 331 | 9/1994 | European Pat. Off. . |
| 0 620 616 | 10/1994 | European Pat. Off. . |
| 0 442 643 | 9/1995 | European Pat. Off. . |

OTHER PUBLICATIONS

European Search Report

*Primary Examiner*—Neil Abrams
*Assistant Examiner*—Daniel Wittels
*Attorney, Agent, or Firm*—Driscoll Wina

[57] ABSTRACT

A shielded electrical connector having a housing and a cover each of which are formed by inmoulding an insulative portion respectively within a respective outer shield portion. Terminals are mounted within the housing and the housing and cover are joined together. Shielding characteristics are improved by a carrier strip interconnecting the shielding of adjacent connectors within a connector stack. Further shielding improvements are recognized by incorporating a contact surface external the shielding for engaging an outer reference terminal. The connector includes terminals having a floatable contact portion and a support feature for preventing damage to the terminals as a result of stubbing with a mating terminal. The connector being impedance matched to the cable.

31 Claims, 17 Drawing Sheets

ELECTRICAL CONNECTOR, HOUSING AND CONTACT

The subject of the invention relates to an electrical connector and, in particular, but not limited to, a shielded electrical connector for use in high frequency cable applications.

In high frequency applications, the trend in industry is to increase the density of electrical connections while reducing the overall cost of the connector. The increase in density is significantly reducing the size of the connectors, along with the housings and contacts therein which has a direct affect upon electrical transmission characteristics and structural integrity. In addition, high frequency applications typically involve shielding the connector structure with a conductive member that is then interconnected to the conductive shielding of the high frequency cable. In high frequency applications, the best situation is when the impedance of the connector structure is exactly that of the impedance of the cable herein. This enables the connector structure to be essentially invisible to the cable, thereby providing the best possible data transmission capability for the particular connector/cable combination.

As impedance is roughly dependant on the square root of the ratio of inductance over the capacity when the density increases the capacitance of a particular connector structure becomes higher and higher due to the small distances between the shielding and the conductors. This results in a lower impedance connector structure at the end of the cable.

Difficulties arise in equalizing the impedance of the connector and the impedance of the cable in high density applications where the small dimensions associated with the high density effectively limit the amount of shielding and space between the contacts and the shielding that may be utilized to control the impedance of the connector. It would be advantageous to provide an electrical contact that enables the impedance of the connector to be matched with the cable.

In high density applications, it is possible that some of the contacts and terminals are not in optimal alignment. There are many electrical terminals known in the art that electrically engage contacts of a mating connector, such as those having a deflectable beam that wipes a pin or tab contact surface as the interconnection is made. In an effort to accommodate the misalignment, float between the contacts and the terminal has been provided in some electrical interconnection devices. This float ensures that over a range of misalignment the contact and terminals can be correctly seated. Therefor, it would be advantageous to provide an electrical contact where the contact portion that electrically engages a mating contact can float relative the rest of the connector.

However, in some smaller, high density applications where the terminals must also be quite small, the thickness of the deflecting beam also becomes small, thereby limiting the structural integrity of the terminal. In these applications, the terminal portion is prone to damage caused by "stubbing". "Stubbing" occurs when the mating tab or pin contact does not slide over the deflecting beam, but rather becomes stuck against it. The causes of "stubbing" can be traced to improper alignment during the interconnection or manufacturing deficiencies such as burrs. As a result of the contact not being able to slide over the deflecting beam, continued insertion typically will cause the beam to buckle and fail. Unfortunately, even if float is provided it is still possible for the contact and the terminal to stub when the connectors are initially mated together. In order to prevent damage from stubbing it would be desirable to provide support to the contact, thereby preventing buckling and the ultimate failure of the contact due to the excessive loading being transferred into the terminal as a result of the stubbing.

In order to provide cost savings in order to produce the high density connectors, it would be desirable to incorporate into the contacts Insulation Displacement Contact (IDC) technology. Typically, high frequency cables will incorporate a TEFLON insulation about the conductor, so it would be desirable to incorporate into the contact IDC structure that is especially useful in terminating conductors encased in TEFLON insulation.

In many applications, especially the data communications industry, the connectors used to form electrical interconnections must be shielded to prevent spurious electrical signals and noise from effecting the signals in the network. It is known in the art to provide conductive shielding around an electrical connector to prevent the adverse interference exterior of the connector from effecting the signals being conducted within the connector. Typically, the conductive shielding is formed as a metal shell that surrounds the terminal block of the electrical connector.

The structure and components of a connector of this type is represented by the structure of the connector shown in U.S. Pat. No. 5,009,616. These connectors have a terminal block that contains electrical contacts that are connected to a cable. A conductive back shell is fitted around the terminal block and the cable. This conductive back shell is separate and distinct from the terminal block and is affixed thereabout by mechanical fasteners. While functionally adequate, having the shielding as a separate component that is distinct from the terminal block adds to the expense of manufacturing the connector. As the requirement for shielded connectors increases and the connectors themselves are miniaturized this expense becomes significant. It would be desirable to form an electrical connector incorporating shielding in an economical manner. It would also be desirable to provide a manufacturing technic that enables a high frequency and high density electrical connector to be formed in an economical manner.

In addition, while the conventional shielding incorporated into the prior art connector described above has been adequate for the applications it was intended, it would be desirable to improve upon the shielding, especially in high density applications where it may be desirable to couple multiple connectors together into a connector stack.

It is an object of this invention to provide an improved shielded electrical connector for high density applications.

It is an object of this invention to provide an improved method of manufacturing a shielded electrical connector.

It is an object of this invention to provide an electrical terminal having a contact end that floats relative a conductor engaging end for aligning with a mating contact.

It is an object of this invention to provide an electrical terminal where the inductance of the terminal and/or its capacitance to the shielding is tailored to effect the overall impedance of the connector.

It is an object of this invention to provide support to a contact portion of a terminal during mating with a complementary contact so that if the complementary contact stubs against the terminal continued insertion does not destroy the terminal.

It is an object of this invention to provide improved shielding and grounding structure for a high density electrical connector.

It is an object of this invention to make high density electrical connectors stackable.

It is an object of this invention to provide additional reference paths for an electrical connector.

It is an object of this invention to provide an improved insulation displacement structure for interconnection to insulated wires, and especially those having TEFLON insulation.

It is an object of this invention to provide a low cost shielded data connector where the conductive electrical shielding and the corresponding portion of the terminal block have been incorporated into a single unit.

It is an object of this invention to provide improved shielding characteristics within a compact and economical package.

It is an object of this invention to prevent damage to the contact arms of an electrical terminal as a result of stubbing.

It is an object of this invention to provide an electrical connector incorporating the forgoing objects.

An object of this invention has been accomplished by creating a shielded electrical connector that has an insulative terminal block having a terminal therein and an outer conductive shell surrounding the insulative terminal block and the terminals therein where the terminal block is inmoulded directly upon the shell to form a unitary structure.

An object of this invention has been accomplished by providing a method of manufacturing the shielded electrical connector that comprises a shield portion and an insulative body portion where the shield portion acts as a palette for the direct moulding of the insulative body portion thereupon.

An object of this invention has been accomplished by interconnecting adjacent shielding with a conductive strap to provide improved positioning and grounding.

An object of this invention has been accomplished by including grounding contacts along the outer shielding of a shielded electrical connector.

An object of this invention has been accomplished by providing an supporting feature along the wall of a housing wherein a terminal is disposed such that when a complementary terminal is mated therewith and stubs thereagainst the contact deflects against the supporting feature such that further insertion of the complementary contact is prevented from buckling the terminal.

An object of this invention has been accomplished by providing a terminal having a contact portion interconnected to a conductor engaging portion by way of an impedance compensating section that has a tailored inductance and/or capacitance.

The invention will now be described by reference to the attached Figures where:

FIG. 13 is a perspective view of an alternative embodiment of the electrical connector of the present invention stacked with other similar electrical connectors to form a connector set;

Figures 1, 2, 3:
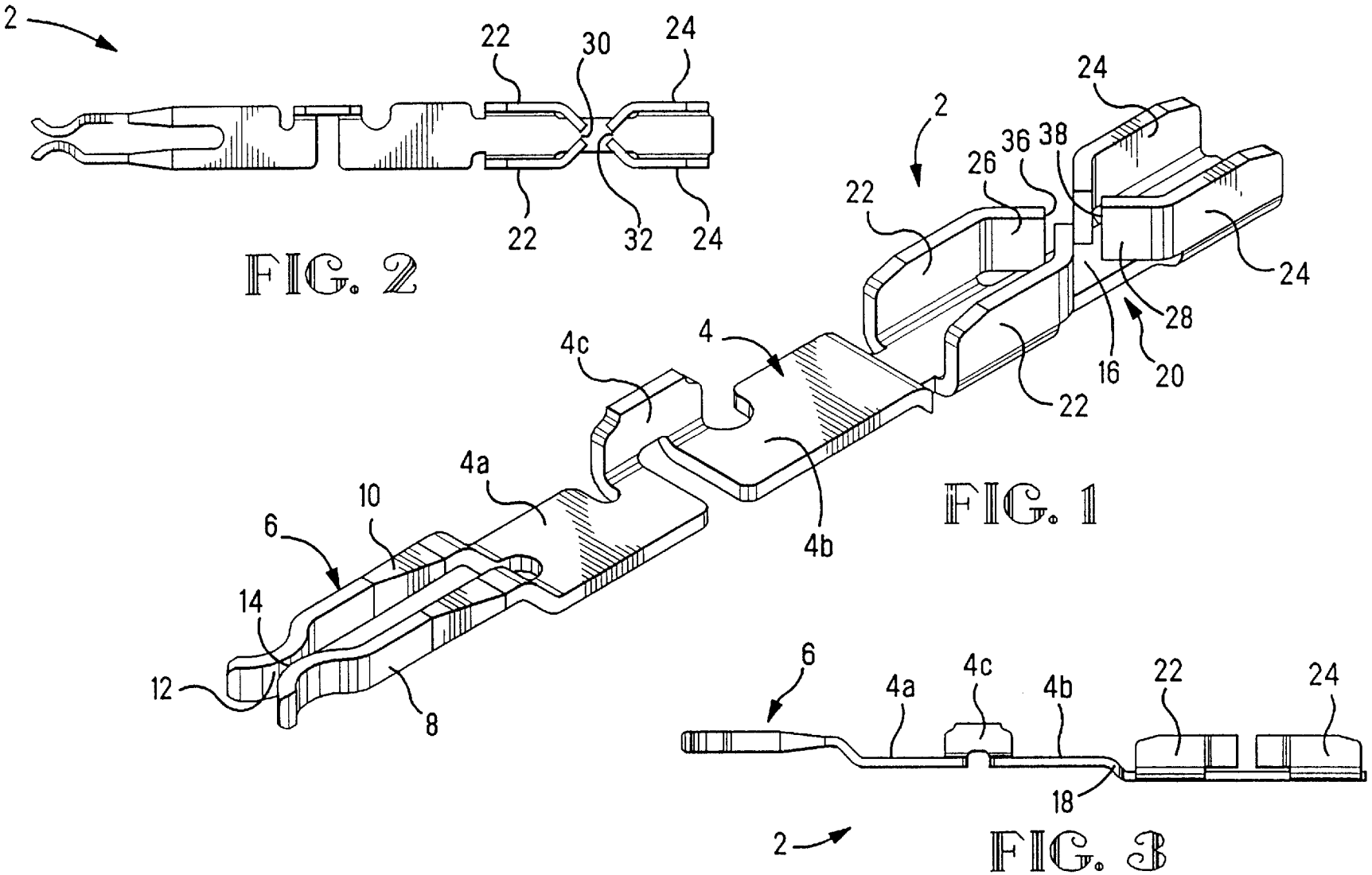
FIG. 1 is an perspective view of an improved terminal according to the present invention.
FIG. 2 is an upper plan of the terminal shown in FIG. 1.
FIG. 3 is a side view of the terminal shown in FIG. 1.
Figure 21:
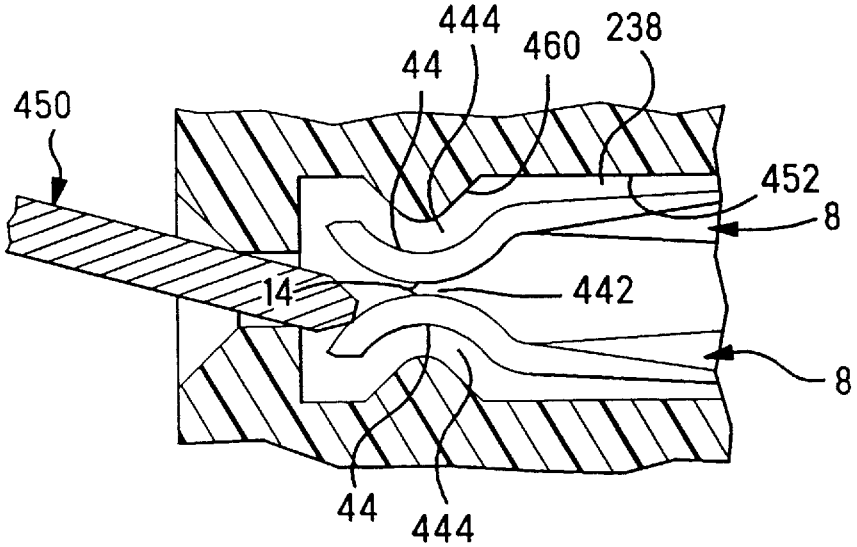
FIG. 21 is a side view showing the mating contact stubbing the terminal.
Figure 14:
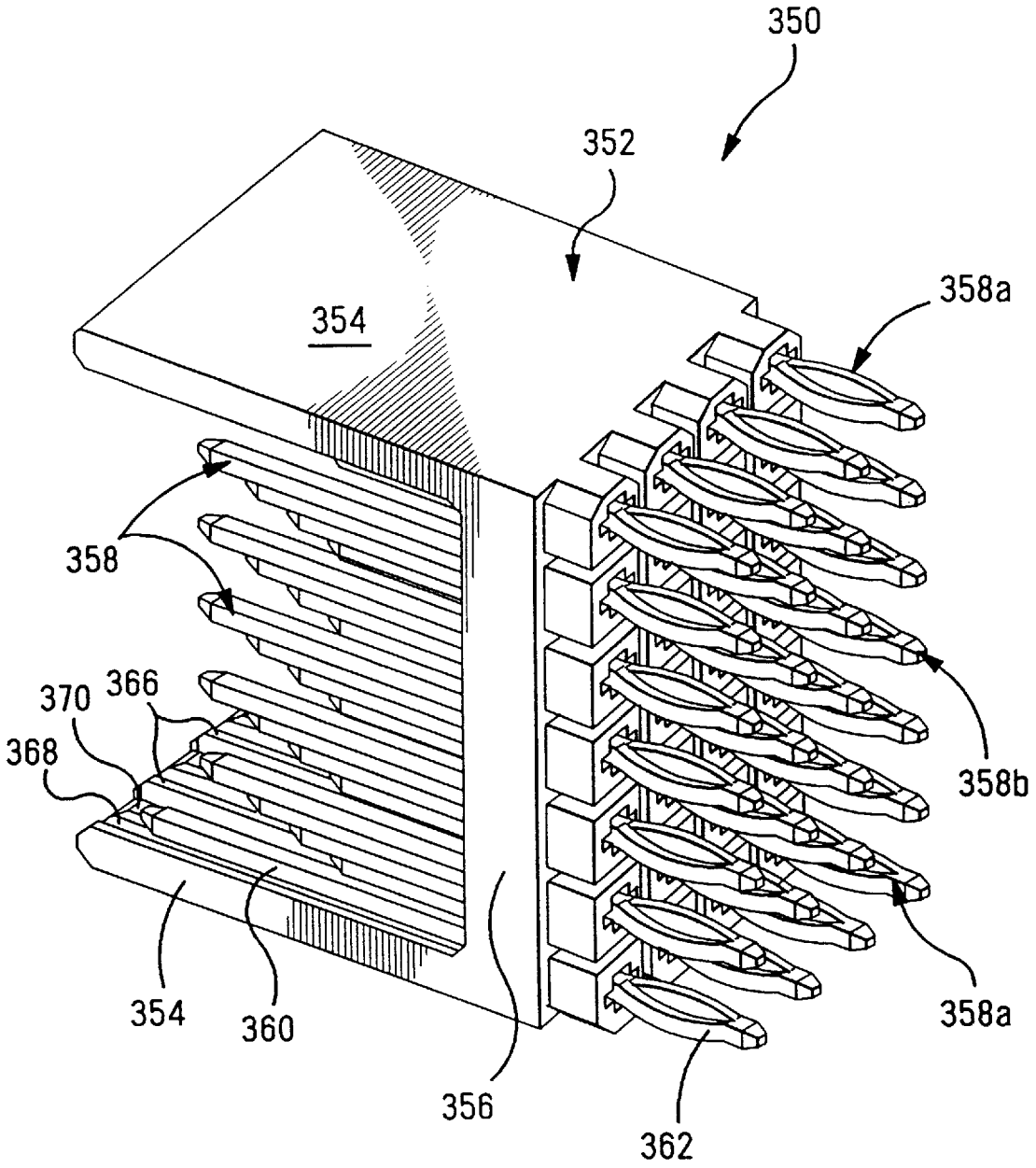
FIG. 14 is a perspective view of a pin header that is engageable by electrical connectors according to the present invention.

With reference first to FIGS. 1–3, an electrical terminal according to the present invention is shown at 2. The electrical terminal 2 includes a base portion 4 which is separated into individual components 4*a* and 4*b* integrally interconnected by a flap portion 4*c* which stands upright to the base portions 4*a* and 4*b*. A contact portion 6 is integrally connected to the base portion 4*a* and includes contact arms 8 which are twisted at 10 such that the planer surface 12 has been displaced through 90 degrees and is now providing parallel surfaces at contacts 14 for interconnection to a mating pin or tab contact (FIG. 14 and FIG. 21). Furthermore, the base portion 4*b* extends rearwardly through a stepped portion at 18 to provide a base portion 16 for an insulation displacement contact that is shown generally at 20. The stepped portion 18 is optional and, in the connector embodiments described below, is incorporated into terminals that need an offset so that the terminal can be brought into contact with the shielding of the overall connector, as will be described below.

The insulation displacement contact 20 of the terminal 2 is defined by forward upstanding and opposing walls 22 and rearward upstanding and opposing walls 24 to form U-shaped sections wherein the mating conductor is to be received. Each wall 22,24 includes an integral plate portion 26 and 28 respectively. The pairs of plates 26 and 28 face each other and are folded inward over the base portion 16 in a converging manner from their respective opposing walls 22,24 to define wire receiving slots at 30 and 32 respectively that take on a chevron-like configuration. It should be appreciated that each of the plate portions 26 and 28 include corners at 36,38 which form cutting surfaces for cutting through the insulation of an insulated conductor to be inserted therein, whereby the corners 36 and 38 can make contact with an electrical conductor forced transversely into the slots 30 and 32.

Additionally, the converging pairs of plates 26 and 28 are oriented to converge towards each other, thereby assuring that pulling or pushing upon the conductor results in one set of plates 26,28 gripping in a self-tightening manner as the conductor is displaced. Furthermore, by having the converging pairs of plates 26,28 converging towards each other enables more effective cutting of the insulation, such that the aforementioned structure is especially effective for cutting through TEFLON insulation. The pairs of converging plates 26,28 cooperate together to grip the insulated conductor in a manner that enables effective cutting of the insulation by trapping a portion of the insulation therebetween.

The contact portion 6 will float relative the insulation displacement portion 20 as a result of the configuration of the base portion 4. As the base portion 4 comprises two separated sections 4*a* and 4*b* that are interconnected by the upwardly folded plate portion 4*c* along one side thereof, the contact portion 6 can be displaced up-and-down and from side-to-side. The upwardly folded plate portion 4*c* acts as a spring element between the contact portion 6 and the insulation displacement portion 20. This float enables alignment and easy mating with the complementary contacts.

Figure 4:
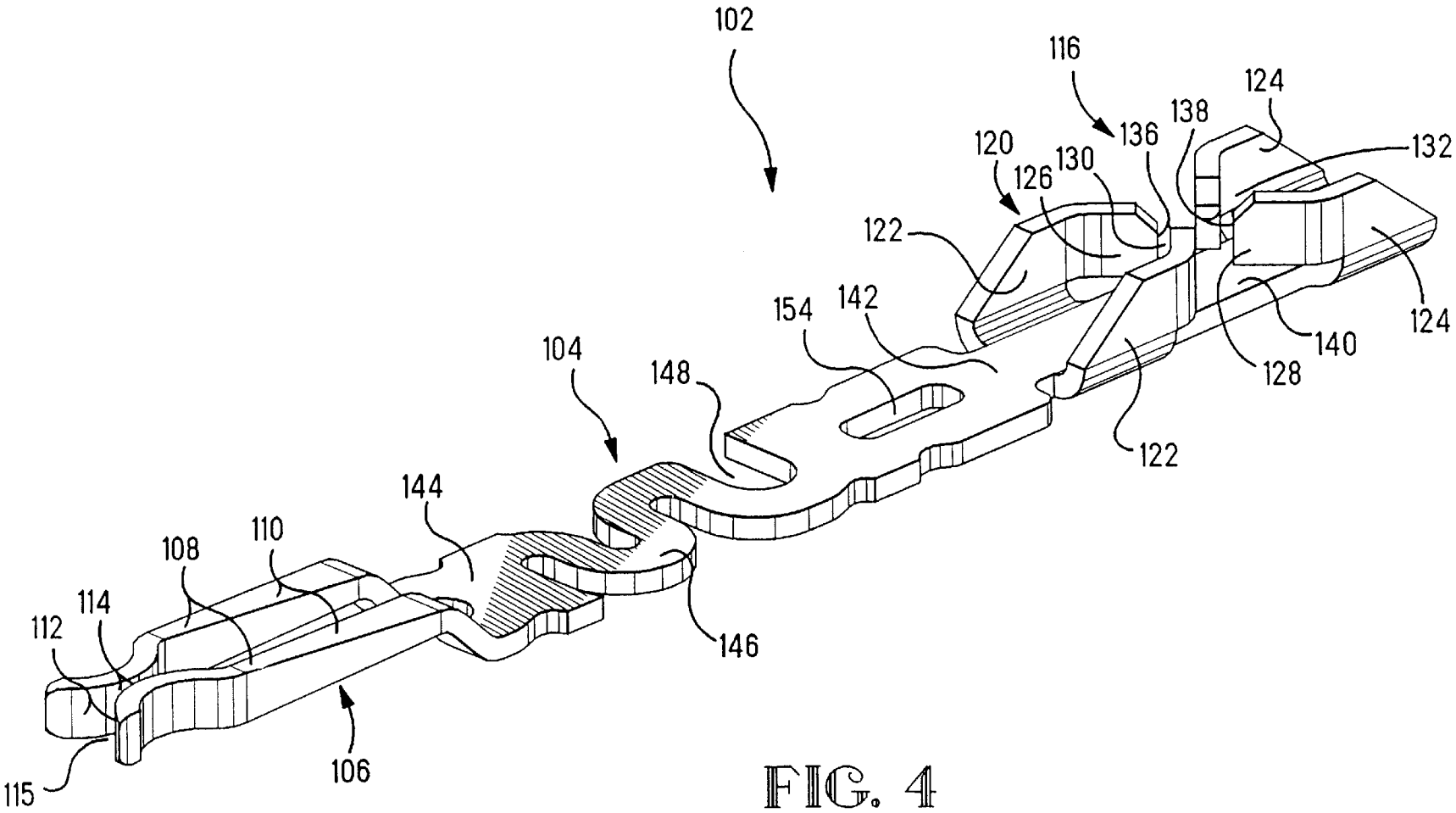
FIG. 4 is a perspective view of an alternative embodiment of the improved terminal of FIG. 1.

With reference now to FIG. 4, another embodiment of the invention is shown generally at 102. For convenience, in this description corresponding reference numerals will be carried through in the 100 series of numbers for relevant features. As with the electrical terminal 2 described above, the alternative terminal 102 includes a contact portion 106 that includes a pair of opposed contact arms 108 that are twisted through 90 degrees at 110 such that what started out as the width of the contact arm 108 is now its height so that the larger planar surface 112 is provided at the contacts 114 for interconnection to a mating pin or tab terminal (FIG. 14 and FIG. 21). The contact arms 108 are of conventional cantilevered construction and converge towards each other at contacts 114 before diverging to form a mouth 115 for receiving the mating pin terminal.

Opposite the contact portion 106 is a conductor engaging portion 116 shown in this embodiment as an insulation displacement contact 120. The insulation displacement contact 120 is defined by upstanding wall portions 122 and 124. The wall portions 122 and 124 are unitary with the contact 102 herein. Each of the wall portions 122,124 include integral respective plates 126,128 that converge towards each other to define wire receiving slots 130,132 respectively. Each of the plates 126,128 include corners 136,138 which form cutting surfaces for cutting through insulation and making contact with the electrical conductor therein when the conductor is forced into the receiving slots at 130,132. Between the cutting edges 138,136 is a central region 140 wherein a piece of the insulation is trapped between the two sets of plate portions 126,128.

The contact portion 106 and the conductor engaging portion 116 are interconnected by base portion 104. The base portion 104 includes a rearward plate section 142 and a forward plate section 144 that are connected to the conductor engaging portion 116 and the contact portion 106 respectively. Located between the two plate sections 142,144 is middle portion 146.

Middle section 146 serves two functions. The first function of section 146 is to act as a positional spring similar to that described above with reference to the embodiment disclosed in FIGS. 1–3. As a positional spring, the middle portion 146 allows for the movement of the contact portion 106 up-and-down and from side-to-side in order to receive the mating pin or tab terminals therein. The second function of the middle portion 146 is to provide an increased inductance. As impedance depends upon the square root of the ratio of inductance over capacitance, impedance will tend to increase with an increase in inductance of the contact structure or a reduction in the capacitance. The particular design of this middle portion 146 will be selected based upon the actual connector configuration and the impedance of the cable to which the conductor is to be affixed. As the connectors are being miniaturized, the amount of free-air space within the connector is reduced as the dielectric of the housing fills a larger and larger portion of the space formed between shield members. Ideally, it is desirable to match the impedance of a connector exactly with the impedance of the cable, thereby making the connector invisible with respect to passing signals. As the space within the shields is unavailable, the serpentine configuration shown in FIG. 4 increases the effective length of the contact and produces a higher inductance.

In the particular embodiment shown, the middle portion 146 is serpentine in nature and defines a notch 148 formed to receive a post 150 of a connector housing 152 (FIG. 5) in order to position and retain the terminal 102 therein. Rearward of notch 148 is an opening 154 extending through rearward plate 142 of the middle portion 104. The opening 154 is created to reduce the capacitance between the contact 102 and the shield 156 (FIG. 5 and FIG. 6), thereby effecting an increase in overall impedance of the connector structure. By selectively establishing the configurations of the serpentine section at 146 and the opening 154 the impedance of the connector can be tailored to provide impedance matching with the cable to which it is to be attached.

Figure 5:
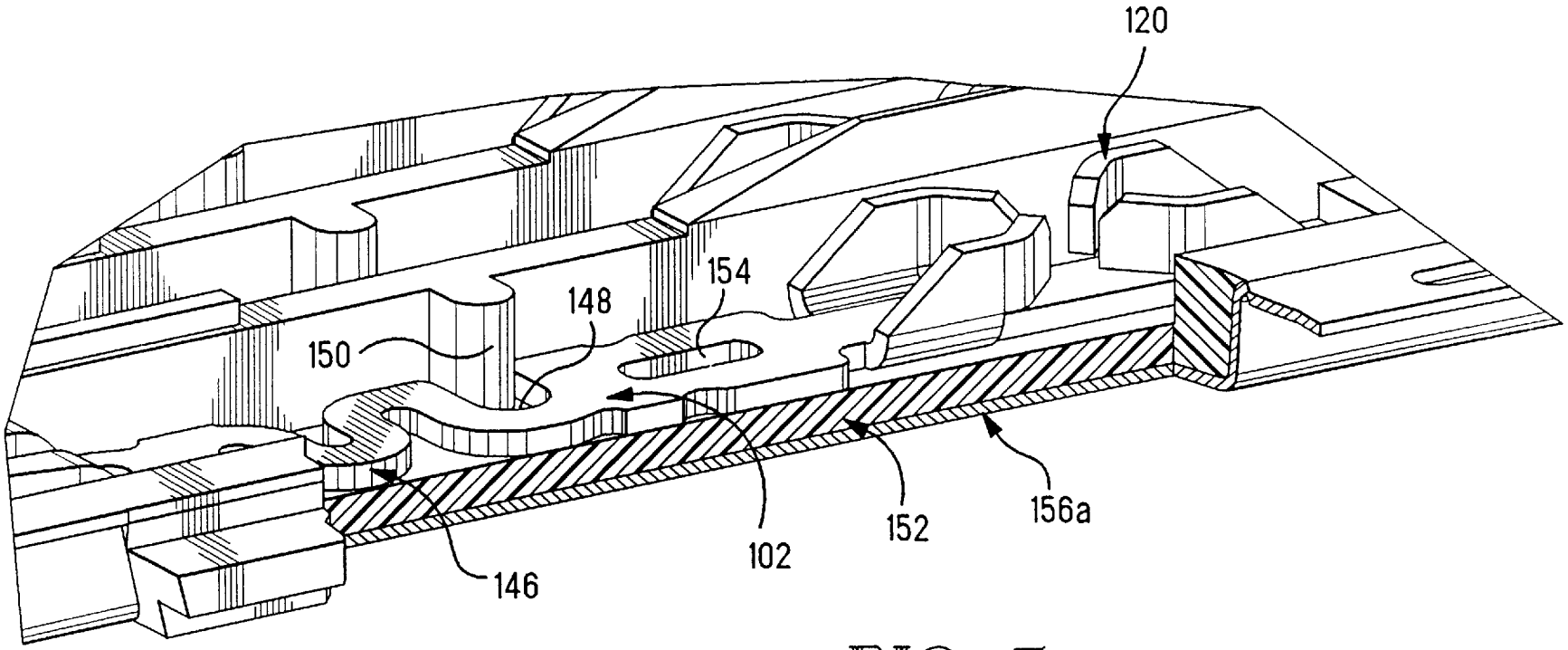
FIG. 5 is a partially cut away perspective view showing the improved terminal of FIG. 4 within a first halve of a connector housing.
Figure 6:
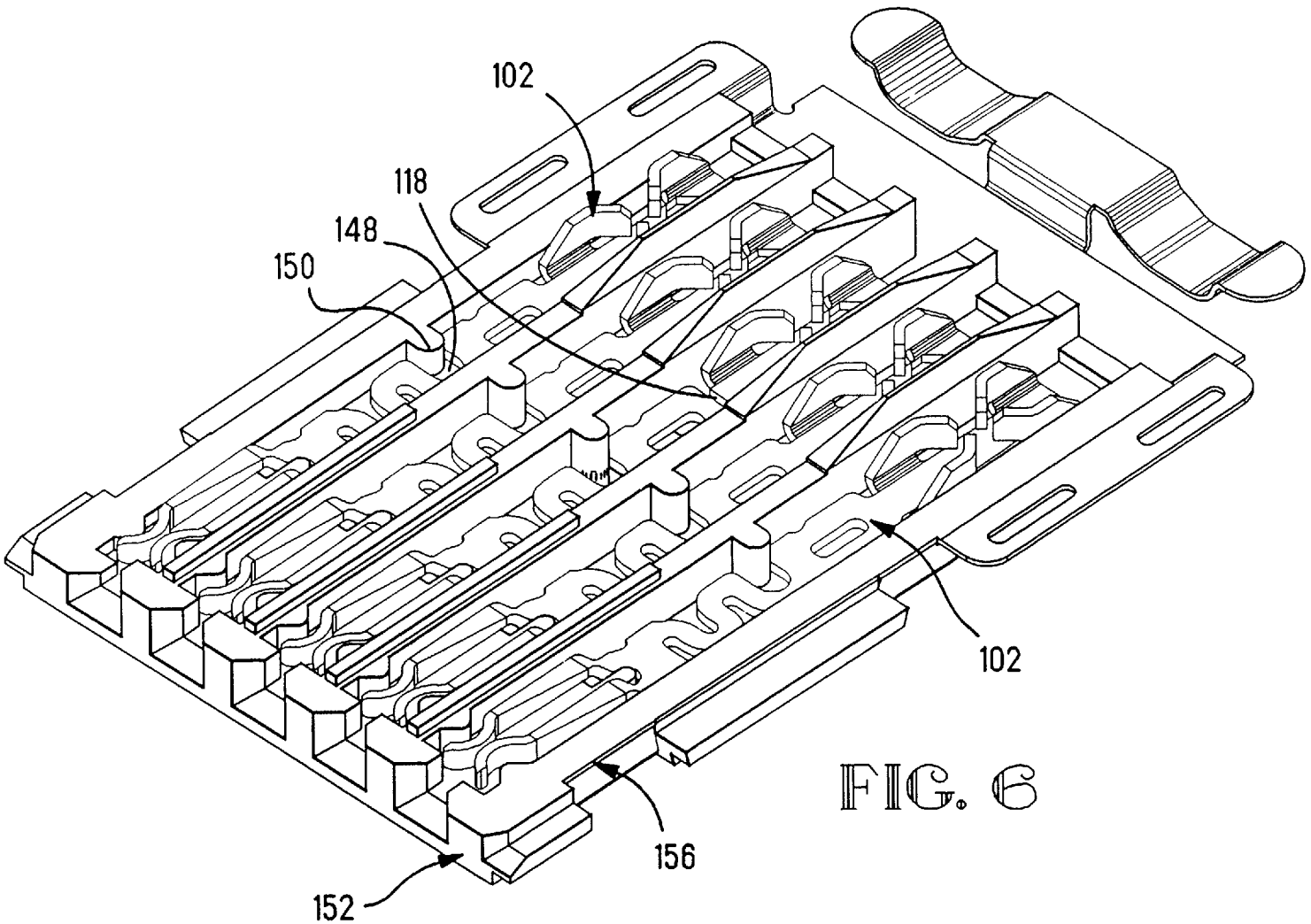
FIG. 6 is a perspective view of the terminal of the entire first connector halve of FIG. 5.

With reference now to FIG. 5 and FIG. 6, the electrical contact 102 is shown positioned in one halve of an electrical connector having an insulative housing 152 surrounded by a conductive outer shell 156*a*. The two pairs of outer terminals 102 are constructed as signal contacts as shown in FIG. 4 and would be connected to the conductors of the two pairs of differential conductors within the cable. The inner contact is a grounding contact that would include a bend at 118 forward of rear plate section 142, similar to that shown at 18 in FIG. 3. This bend enables the conductor engaging end 116 to be in direct contact with the shielding member while the contact arms 106 and the middle portion 104 are supported by the insulative material of the housing 152. With only this slight difference, either terminal 2 or 102 can be used as a signal contact (as shown in FIG. 4) or a ground contact (as shown in FIGS. 1–3), where the bend 18,118 enables the contact portion 16,116 to be brought into direct contact with the shielding 156, in an electrical connector assembly incorporating a high density of interconnections on very close centerlines.

Figure 7:
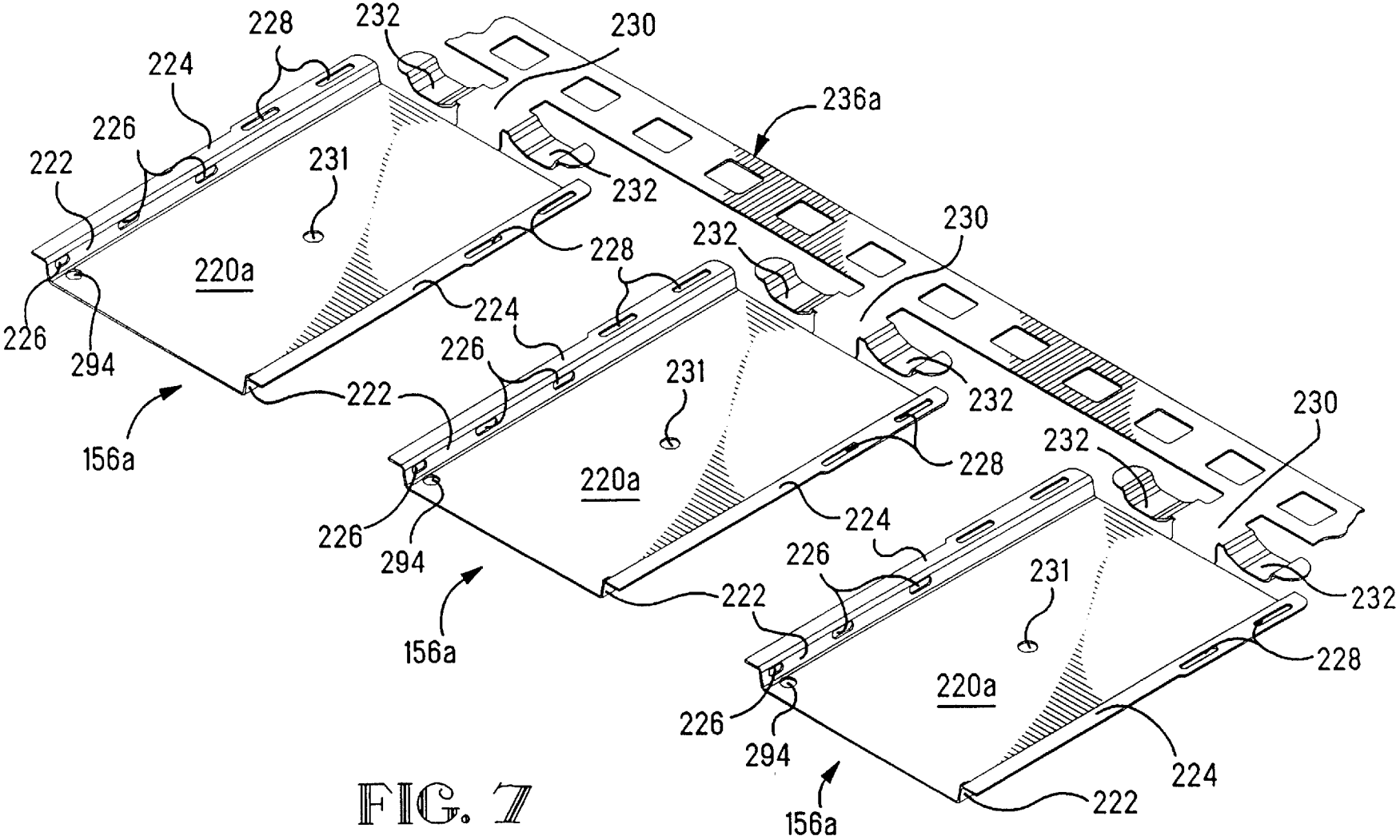
FIG. 7 is an perspective view of electrical shield sections upon a carrier strip utilized in the manufacture of the connector housing partially shown in FIG. 5 and FIG. 6.
Figure 8:
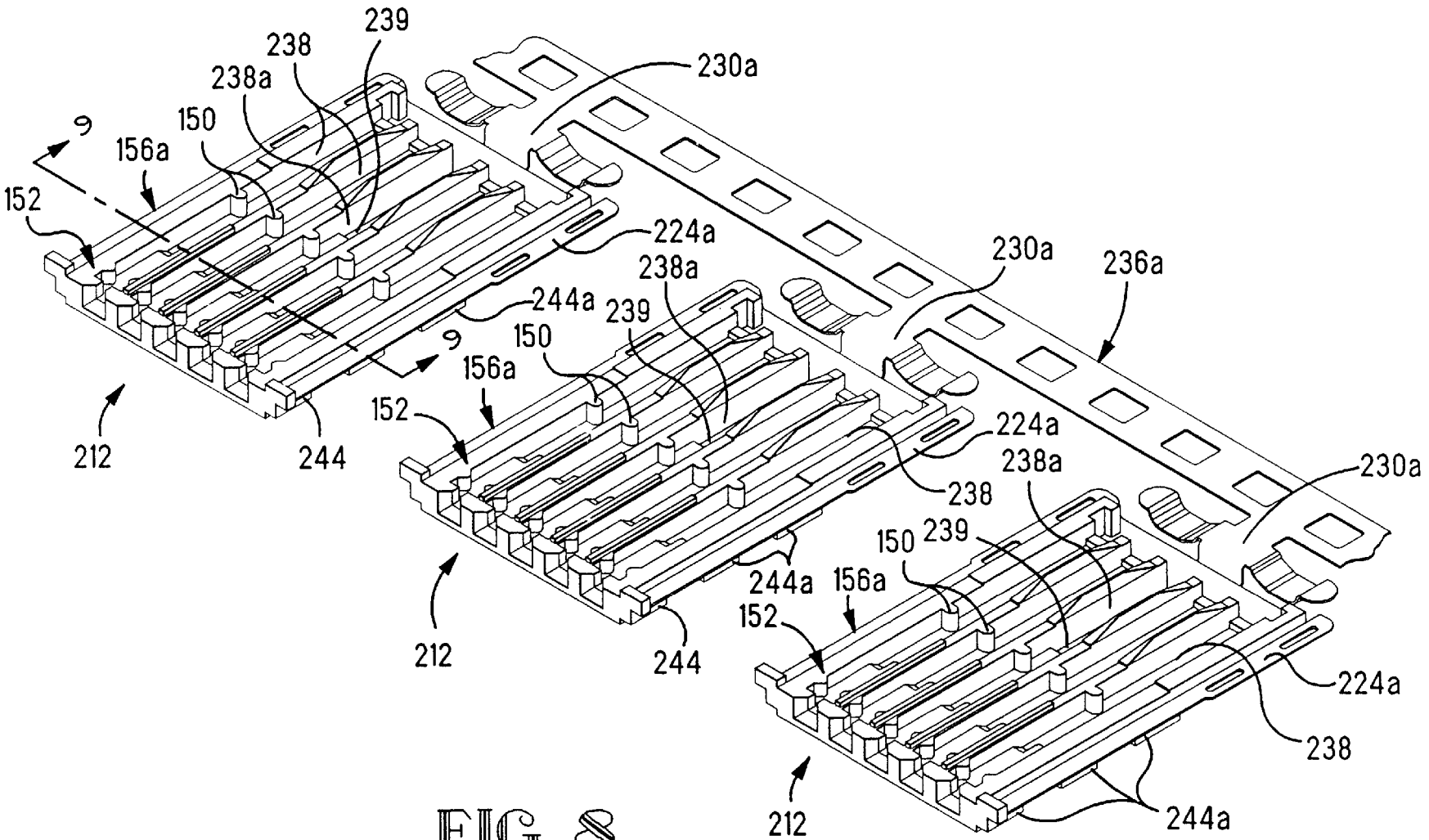
FIG. 8 is a perspective view of housing sections of the connector housing showing inmoulded housings within the shield section of FIG. 7.
Figure 10:
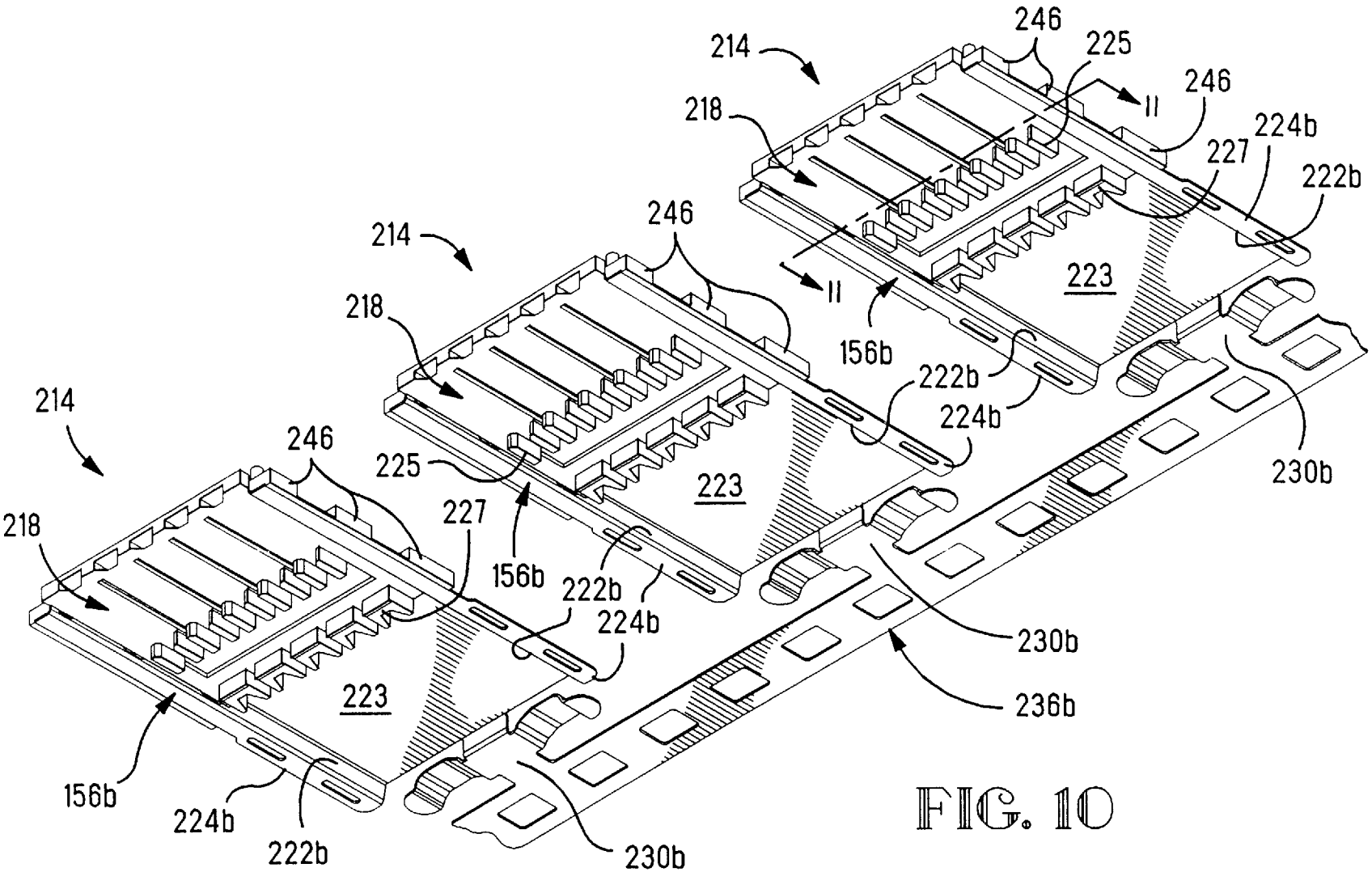
FIG. 10 is a perspective of cover sections of the connector housings showing the inmoulded cover section within shield sections of FIG. 7.
Figure 12:
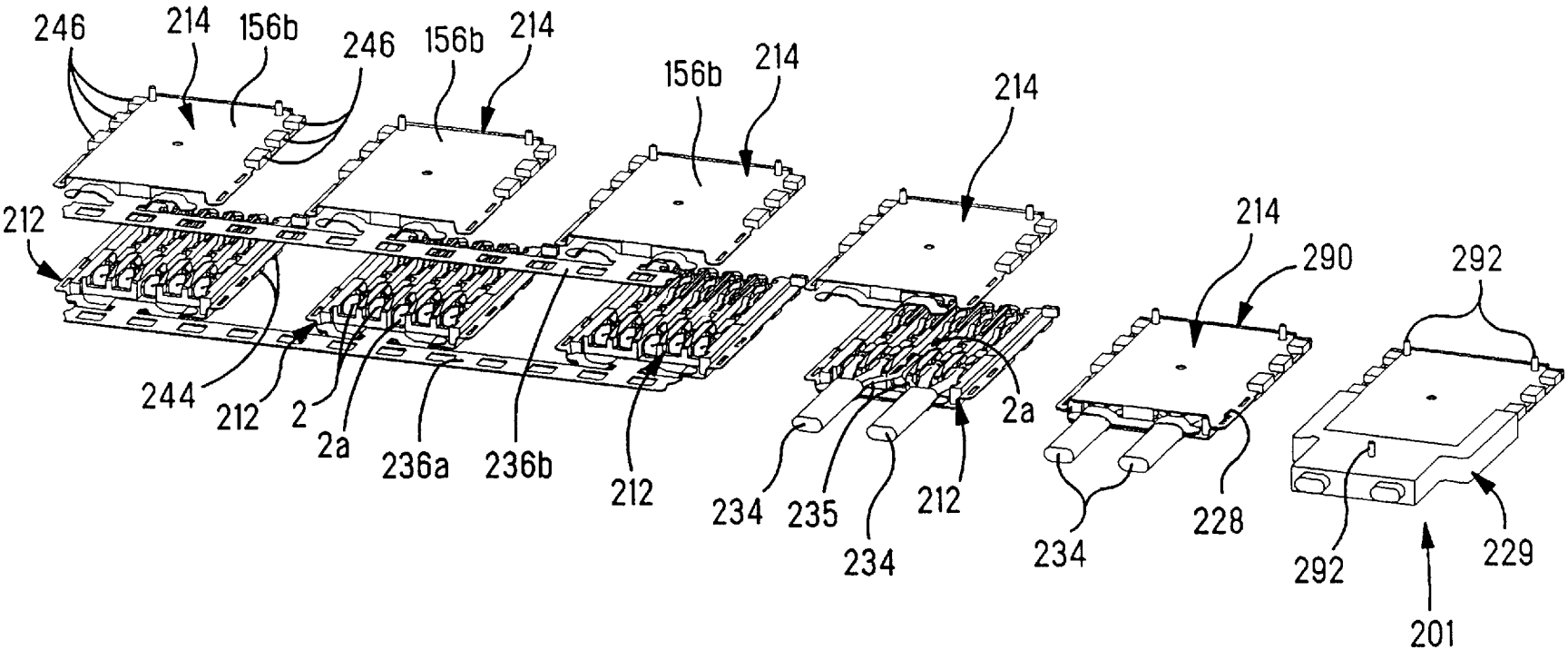
FIG. 12 is a perspective over-view of the assembly process used to manufacture of the complete electrical connectors according to the present invention.

As a brief overview, with reference to FIG. 12, the illustrated embodiment of the present invention utilizes a pair of identical shield sections 156*a,b* to produce a housing 212 and a cover 214, each of which have an inmoulded insulative section 152 and 214 moulded directly thereupon as shown in FIG. 8 and FIG. 10 respectively. With reference now to FIG. 7, the shield sections 156*a* have a flat bottom inner surface 220*a* with opposing side walls 222 that extend upward from the bottom surface 220*a* into outwardly extending flanges 224. The side walls 222 include ports 226 therealong that are used to retain the inmoulded insulative sections 152 and 214, as described below. The flanges 224 include auxiliary ports 228 that are used to retain an overmoulded housing 229, as described below with reference to FIG. 12.

At one end of the shield sections 156*a* is a strain relief 230 that includes a pair of troughs 232 for receiving portions of a cable 234, as further shown in FIG. 12. Although it is desirable from an economics standpoint to use the same shield section 156 for both the housing 12 and the cover 14, differently configured sections may be used as required. To further emphasize that the shield section 156 need not be the same, when referring to the features of the shield section 156 associated with the housing 212 the designation "a" will be included and the designation "b" will be included for the features associated with the cover 214. The shield members 10 are manufactured using conventional stamping technics out of coiled strips of metal and may be left attached to carrier strip 236*a,b*. By leaving the shield sections 156*a,b* attached to the carrier strip 236*a,b* automated production technics may be easily incorporated into the manufacturing process, as is shown in FIG. 12.

Figure 9:
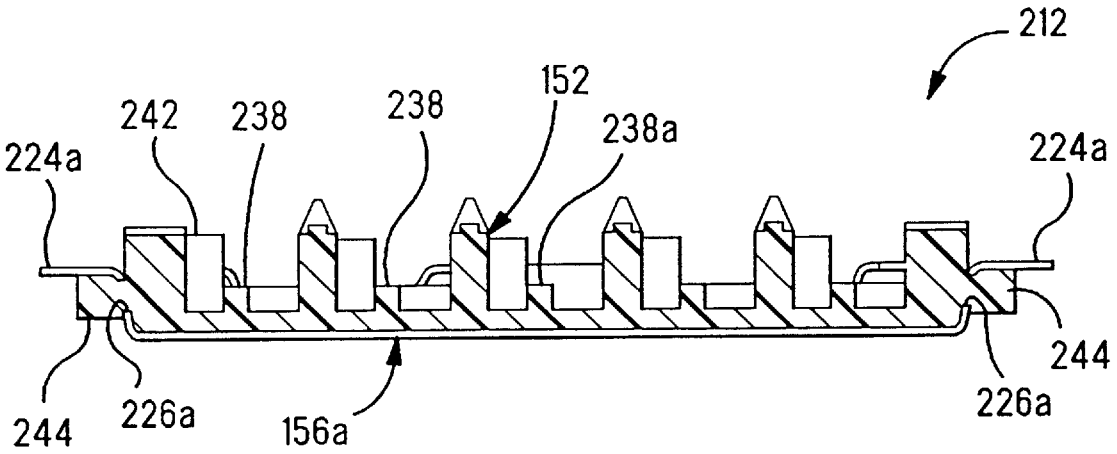
FIG. 9 is a cross-sectional view of the housing section of FIG. 8 taken along line 9—9.

With reference to FIG. 8 and FIG. 9, housings 212 have been formed while the shield sections 156*a* are still on carrier strips 136*a* by moulding the housing inmould 152 directly onto the shield section 156*a*. The housing inmould 152 has a number of channels 238 for positioning therein signal-style terminals 102 or those of FIG. 1–3 without step 18. Channel 238*a* is exposed to the shield section 156*a* at location 239 so that a ground-style terminal 2 or 102 with a stepped portion 118 disposed therein, as shown in FIG. 6, may be connected to the shield section 156*a* along the wire connecting section in order to establish a central ground contact. The shielding or drain wires of a co-axial or twin-axial cable may be attached thereto.

The channels 238,238*a* include a post 150 for retaining the terminal 2,102 therein as described below. The housing inmould 152 is moulded directly onto the inner bottom surface 220*a* of the shield section 156*a*. This process enables the shield 156*a* itself to be used as part of the moulding structure, thereby reducing the costs required to manufacture and to advantageously enable low-profile shield-housing combinations to be produced. As there might be a tendency for the bottom surface to bow during the moulding process a tooling hole 231 is included.

In order to assure the inmoulded housing 152 is maintained in proper position within the shield section 156*a*, the moulding process produces housing lugs 244*a* that extend out of the ports 226*a* in the side walls 222*a* of the shield section 156*a*, as best seen in FIG. 9. These lugs 244*a* are formed by allowing the material used to form the inmould 152 to flow outward through the ports 226*a*. Cavities are included in the moulding structure (not shown), where the shield 156*a* is seated for the moulding process that correspond to these lugs 244*a*. The lugs 244*a* are formed along the outside of each of the oppositely disposed side walls 222*a* into a shape that is larger than the ports 226*a*, the moulded housing portion 152 on the inside of the walls 222*a*, which is also larger than the ports 226*a*, is captivated in the shield section 156*a*. This process forms an integral housing section 212 comprising both shield 156*a* and insulative housing inmould 152, while still maintaining the newly formed housing section 212 on the carrier strip 236*a* of the shield member 156*a* for further processing and connector assembly.

Figure 11:
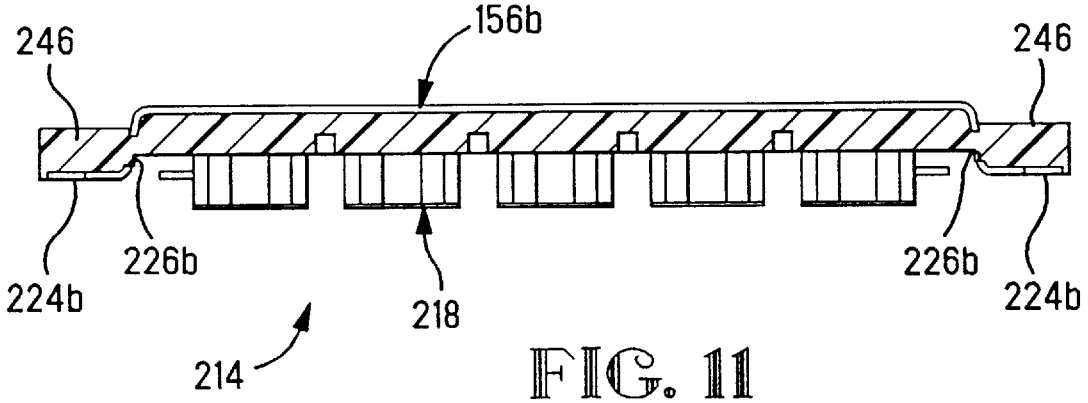
FIG. 11 is a cross-sectional view of the cover section of FIG. 10 taken along line 11—11.

With reference to FIG. 10 and FIG. 11, the cover 214 is formed by inmoulding the cover inmould 218 directly to shield section 156*b* while the shield section 156*b* remains upon it's respective carrier strip 236*b*. The cover inmould 218 is formed only at the front half of the shield 156*b*, thereby leaving a portion 223 of the central plate 220 of the shield 156*b* exposed, thereby minimizing the amount of dielectric to be used. The cover inmould 218 includes a forward row of upstanding lugs 225 and a rearward row of upstanding lugs 227 that, when the housing 212 and the cover 214 are assembled, assure the contacts 2 or 102 remain properly seated within their respective channels 238.

As described above with reference to the housing 212, the cover inmould 218 is retained within the shield section 156*b* by cover lugs 246 that are an integral part of the inmould section 218 that has flowed out through the ports 226*b* of the shield section 156*b*. As will be apparent from a comparison of FIG. 9 and FIG. 11 the cover lugs 246 and the housing lugs 244 do not have to be similarly proportioned. In addition to retaining the housing inmould 152 and the cover inmould 218 to their respective shield sections 156*a* and 156*b*, the housing lugs 244 and the cover lugs 246 can be configured to provide a polarizing or keying function. In this particular embodiment, the cover lugs 246 can be observed to extend outward further along the flange 224*b* than the housing lugs 244 extend along the flange 224*a*. In addition the lugs may be joined together to form rails, as shown and described with reference to FIGS. 13–19. It would also be possible to configure the lugs 244,246 to define the perimeter of the connector, so that the connector would be closely received within a mating receptacle or housing, or provide for any other function accomplished by the exterior of a connector housing where it is more advantageous to do so by way of moulding as opposed to incorporating these, possibly complex features into the stamping process used to form the shields 156*a,b*.

With reference to FIG. 12, the remaining assembly operations are presented in this drawing. The housings 212 are shown attached to their respective carrier strips 236*a* with the terminals 2 and 2*a* mounted therein. The covers 214 are shown above the housings 212 on terminal strip 236*b*. Proceeding left to right in the assembly overview, the next step shows portions of a twin-axial cable 234 inserted into the housing 212. The outer portion of the cable is positioned in the troughs 232 of the strain relief 30. It is possible for the conductive foil common to this type of cable to be exposed to the troughs 232 for electrical engagement therewith, thereby also commoning this portion of the cable to the shielding 156*a*,156*b*. The conductors of the cable 234 are terminated in their respective terminals 2 by pressing the insulated conductor into the insulation displacement portion of the terminal 40. As stated above the drain wires of a cable of this type may also be terminated in the ground contact, if desired. Other configurations may also be desirable for connecting the conductor to the terminal 2 than insulation displacement. The housing 212 and the cover 214 are next shown as having been separated from their respective carrier strips 236*a,b* as they are being brought together. In the next step, the cover 214 and the housing 212 are joined together to form an electrical connector 290. The housing 212 and cover 214 may be joined by mechanical features, resistance, laser or spot welding or another technic. In this embodiment, they are joined along the flanges 224*a,b* between the lugs 244,246 and along the strain reliefs 230*a,b* between the troughs 232*a,b*. If desired, in a final step, an overmoulded housing 229 is moulded over the strain relief 230*a,b* and the rear ends of flanges 224*a,b* of the shield sections 156*a,b*. The material used in this overmould flows through the auxiliary ports 228 to form an integral unit that is anchored to the connector 290. This housing 229 provides additional strain relief for the cables and a way to easily handle the connector 201.

It is an advantage of this invention that electrical connectors 201 having minimal thickness can be produced. This advantage may be further exploited by adapting connector 201 to enable the connectors 201 to be stacked together, thereby providing the highest density possible. As seen in FIG. 12, the cover 214 and overmoulded housing 229 includes studs 292 extending above the shield section 136*b* through holes 294 (FIG. 7) therein. As in this embodiment the shields 156*a,b* are identical, these studs 292 formed during the inmoulding of the cover 214 may be received in corresponding holes in the shielding 156*a* of the housing 212 so that they are positioned within seats (not shown) formed in the inmould 152 of housing 212.

With reference now to FIG. 13, such a connector stack is shown at 300. The connector stack 300 incorporates a pair of alternative embodiment electrical connectors 302 to the ones described above. While a connector stack 300 of two electrical connectors 302 is shown in the included figures, it is envisioned that additional connectors 302 may be advantageously incorporated into the stack 300, as will be further described below.

Each electrical connector 302 has a housing 312 and a cover 310 constructed basically as described above, where shields 311*a,b* have inmoulded insulative portion 116,118 respectively. The shield sections 311*a,b* are similarly U-shaped to those described above with a flat base 320 and upstanding side walls 322*a,b*. In this embodiment, the flanges 224*a,b* of the shields 156*a,b* described above, do not extend as far along the side walls 322*a,b*, instead they are shortened so that they are entirely encapsulated within the overmoulded strain relief housing 329, whereby sides 322*a,b* extend forwardly in an unconnected manner. At the front edge 325 of the shield 311*a,b*, within the plane of the base 320*a,b*, tabs 327*a,b* are formed that extend out beyond their respective sides 322*a,b*. These tabs 327 will be described more fully below.

The inmoulded insulative portions 316,318 are retained within their respective shield portions 311*a,b* as described above. However, rather than forming the multiplicity of lugs 244,246 extending from respective ports 226, single rails 344*a,b* are formed along the respective side walls 322*a,b*. These rails 144*a*,144*b* are used to locate, polarize and aid in mating the connectors 302, individually or as part of a stack 300, with a mating header 350 (FIG. 14).

Figure 19:
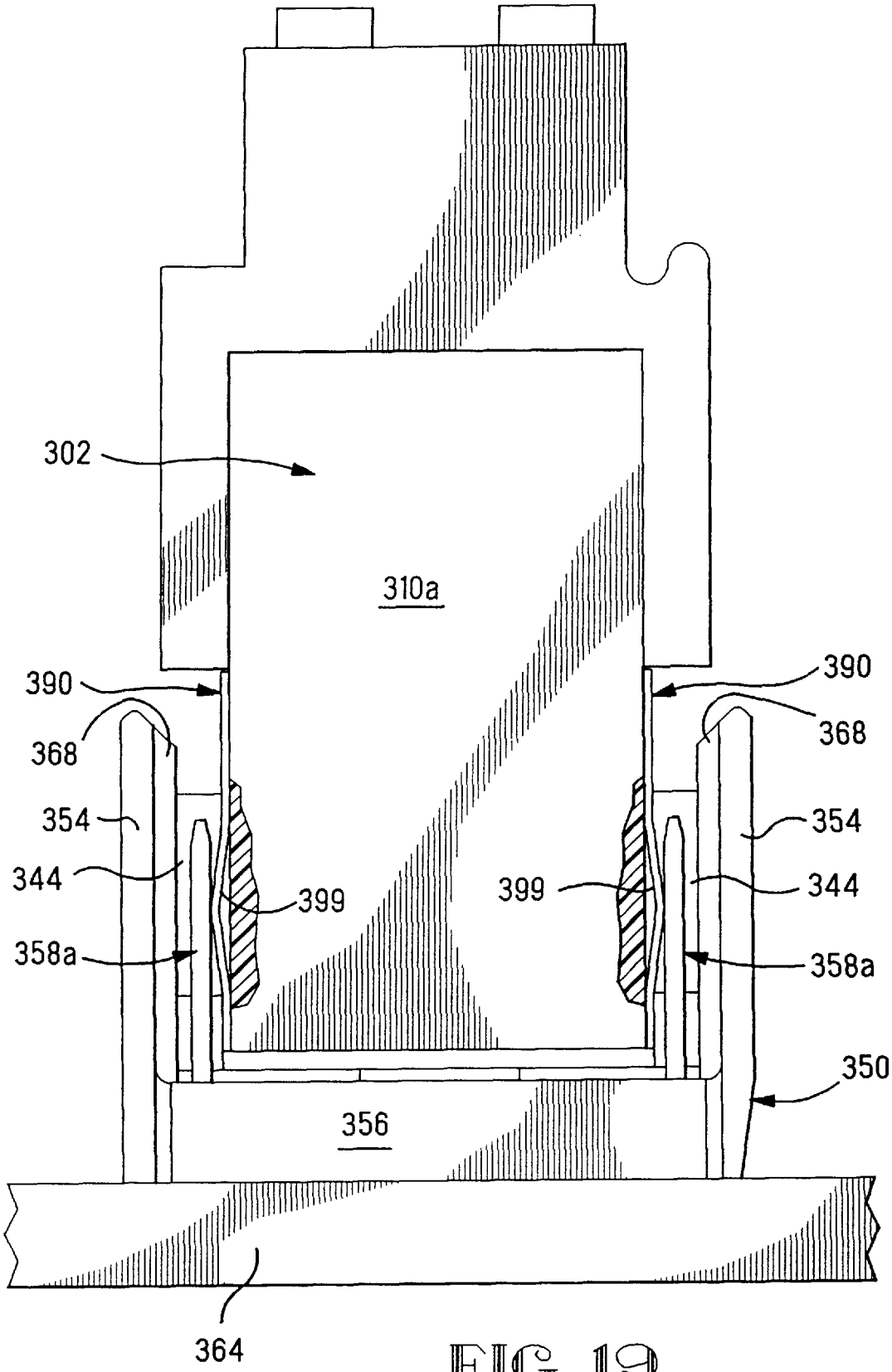
FIG. 19 is a partially cut-away side view of the connector set of FIG. 18 being received within the pin header of FIG. 14.

Once the connectors 302 are assembled, as described above, each connector 302 includes two pairs of signal ports 231 separated by a central grounding port 233. These ports 231,233 are open so the terminals 2,102 (described above, but not shown here) that are within the connector 302 can engage pin terminals 358 in the mating header 350, as seen in FIG. 14 and FIG. 19.

The header 350 includes a U-shaped moulded plastic housing 352 having a pair of outstanding walls 354 extending from a base 356 through which a plurality of pin terminals 358 extend. The pin terminals 358 have a pin end 360 for engagement by terminals, such as those constructed similarly to those depicted at 2 and 102 above. Opposite the pin end 360 is a conductor engaging end 362, in this case adapted for plated through-hole engagement with circuit traces incorporated into a substrate, such as a printed circuit board 364 (FIG. 19). The interior surface 366 of walls 354 include grooves 368 and 370 for receiving the lugs 244,246 or rails 344*a,b* of the previously described connectors 201, 302 or 300 for positioning or polarizing relative the pins 358.

While header 350 includes four columns of seven pin terminals 358 each, additional columns or pins may be included as desired. Furthermore, in order to incorporate a high density of pin terminals 358, the center-to-center spacing of 2 millimetres is achievable. In at least one form, the outer terminals 358*a* and the central terminal 358*b* are connected to a reference plane by way of the substrate 364 (FIG. 19).

Although the shielding offered by the outer shields 311*a,b* described above and the ground terminal within the central port 133 and connected to the drain wires of the cable the connector is attached to is adequate for numerous applications, improved shielding is sometimes desirable. In order to accomplish this, the prior art has resorted to enclosing the entire connector-header interface within a conductive housing and even going as far as wrapping the outside of the cable with a conductive foil. This is very expensive and adds considerable structure to the interconnection.

Figure 15:
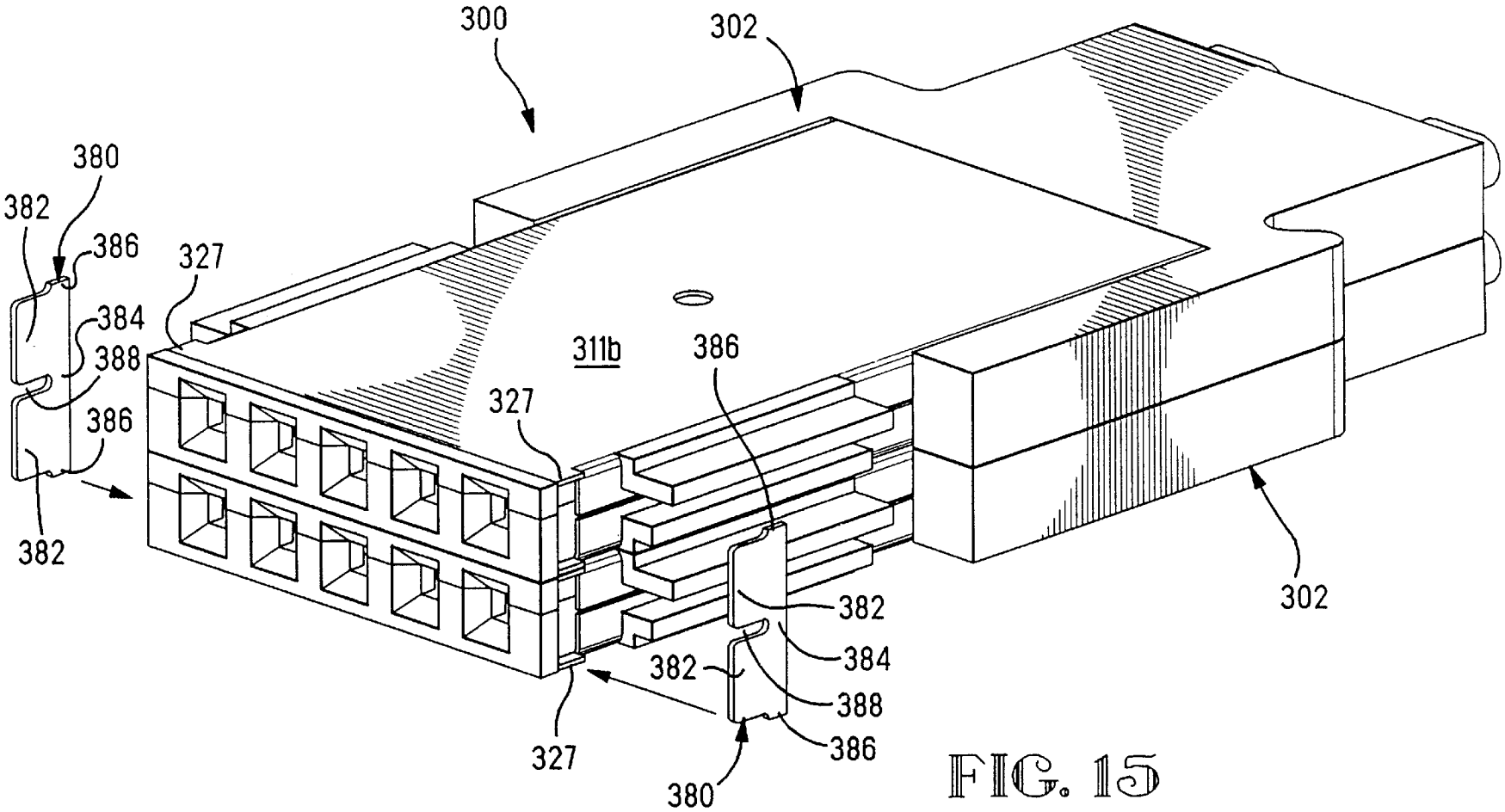
FIG. 15 is a partially exploded perspective view of the connector set of FIG. 8 incorporating a carrier strip.
Figure 16:
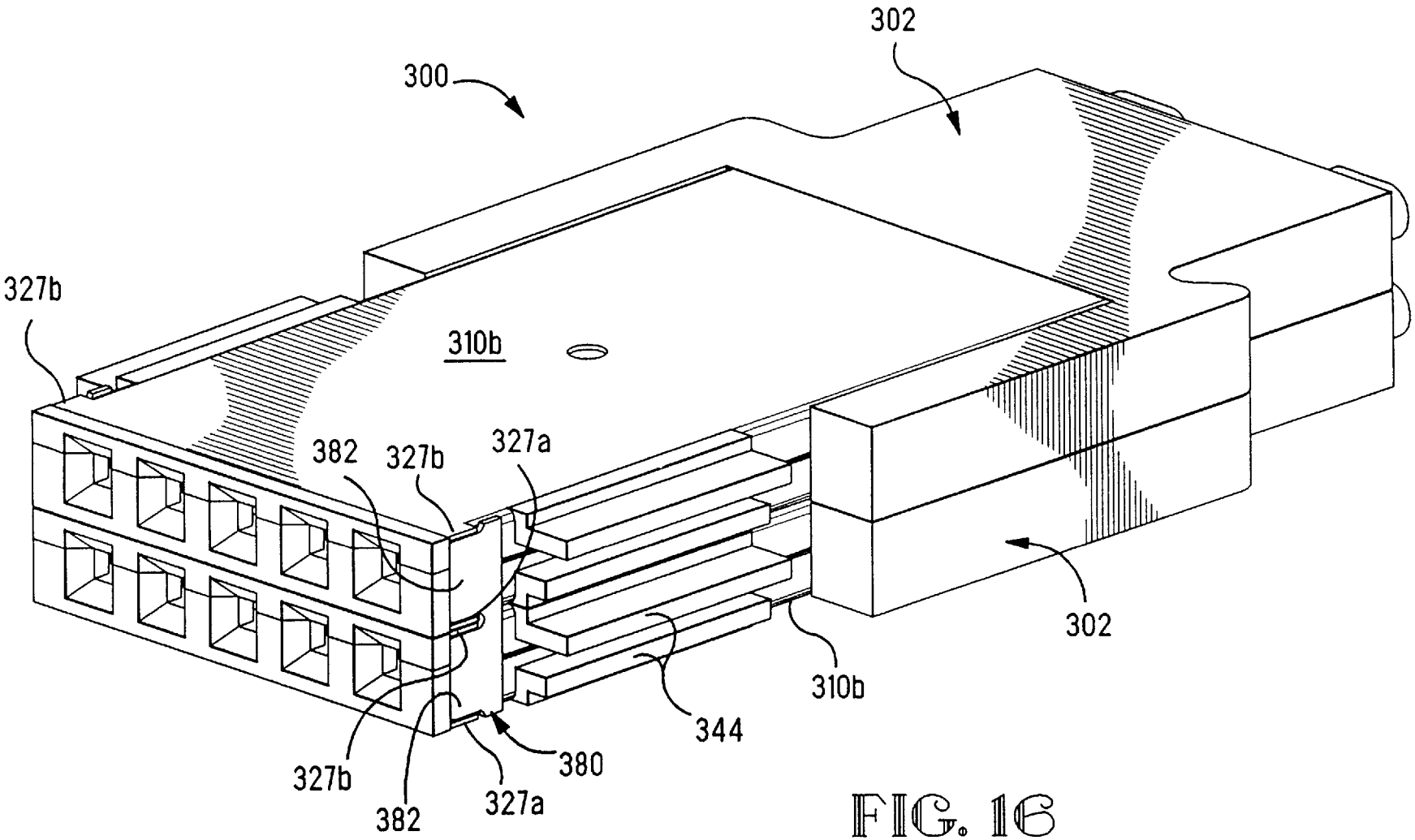
FIG. 16 is a perspective view of the assembled connector set of FIG. 15.

With reference now to FIG. 15 and FIG. 16, the connector stack 300 of FIG. 13 is shown with a pair of carrier strips 380 disposed therealong. These carrier strips 380 are conductive elements and are affixed to the shielding 311*a,b* of the connector 302, such as by laser welding, where an electrical interconnection is assured. Each carrier strip 380 includes a plate 382 extending forward from a strip 384 to fit between the tabs 327*a,b* extending from the shield 311*a,b*. Strip portions 386 extend from either side of the plate 382. Where only a single connector is being used, the carrier strip 380 is used to join the shields 311*a,b* together in a manner that provides positive electrical interconnection therebetween at the front of the connector and holds the front of the connector together in a manner that assures the overall height profile of the connector 302 is accurately maintained.

As illustrated in FIGS. 15 and 16, where a plurality of connectors 302 are to be formed into a connector stack 300, the carrier strip 380 serves both mechanical and electrical functions with respect to the stack 300 and the individual connectors 302. Mechanically, the carrier strip 380 holds the shields 311*a,b* together at the front end of each connector 302 and assures the accurate pitch positioning of the connectors 302 within the stack 300 in order to minimize any inaccuracies resulting from tolerance build-up that may occur over the connectors 302. An opening 388 is formed between each plate 382 of the carrier strip 380 that is sized to receive adjacent tabs 327*a*,327*b* of the stacked connectors 302. Furthermore, when the connectors 102 are properly positioned, for example in a tooling fixture, such that the ports 331,333 are located to comply with pin terminals 358 of the header 350, affixing the carrier strip 380 assures that the desired positioning will be maintained, thereby enabling stacks 300 containing a large number of connectors 302 to be realized. Electrically, as the carrier strip 380 is conductive, the carrier strip 380 acts not only to interconnect the shields 311*a,b* of the same connector 302 but also to electrically interconnect the shielding of all of the connectors 302 within the stack 300. The electrical interconnection, by way of the carrier strip 380, provides a conductive strip across both sides of the stack, thereby improving the low frequency performance of the connector stack 300. The performance benefits are provided without detracting from the other desirable features of the connector package, for example the size of the connector and the use of the rails 344.

Figure 18:
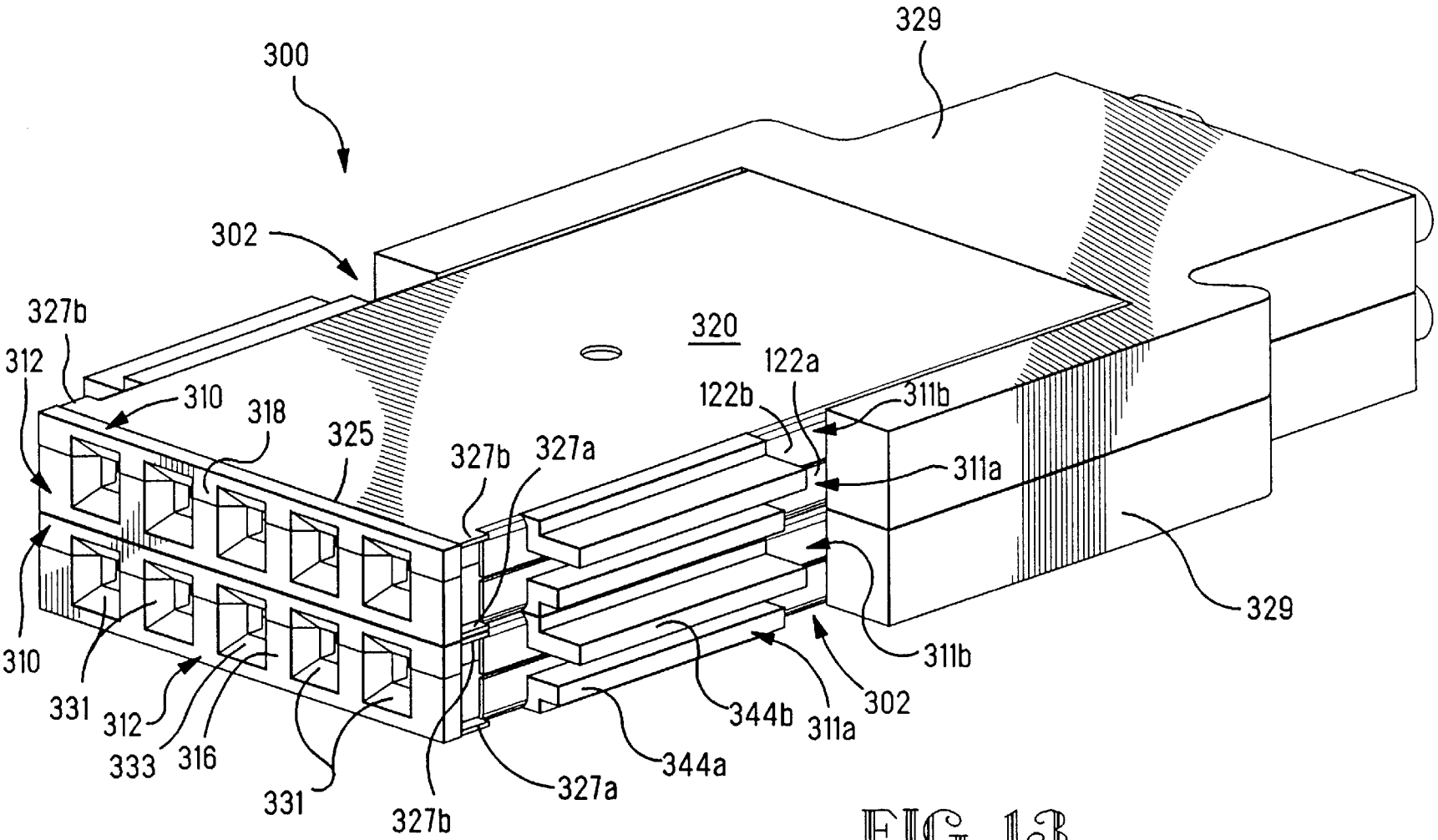
FIG. 18 is a perspective view of the connector set of FIG. 17.
Figure 17:
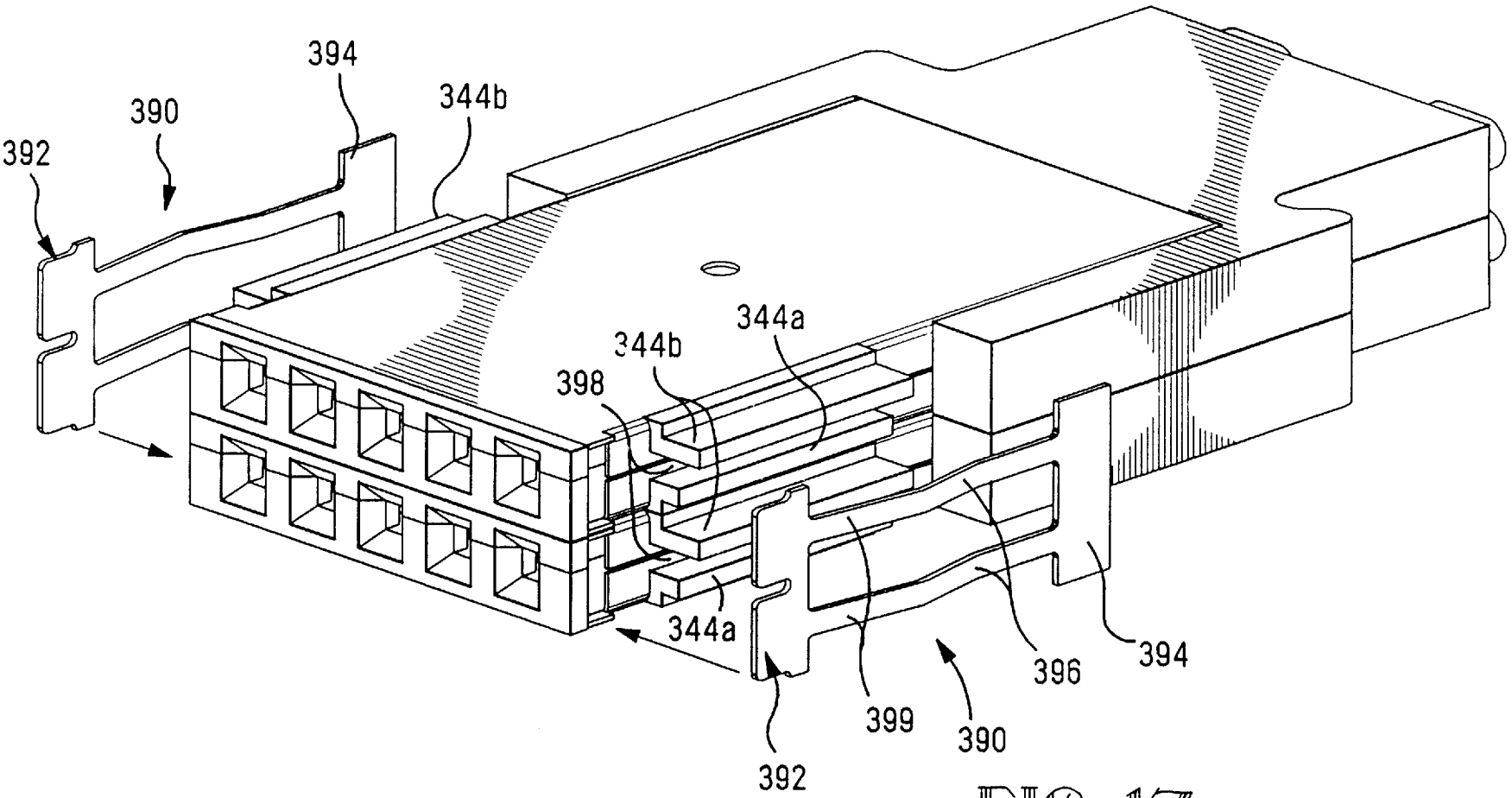
FIG. 17 is a partially exploded perspective view of the connector set of FIG. 8 incorporating contacts as part of an alternative carrier strip.
Figure 18:
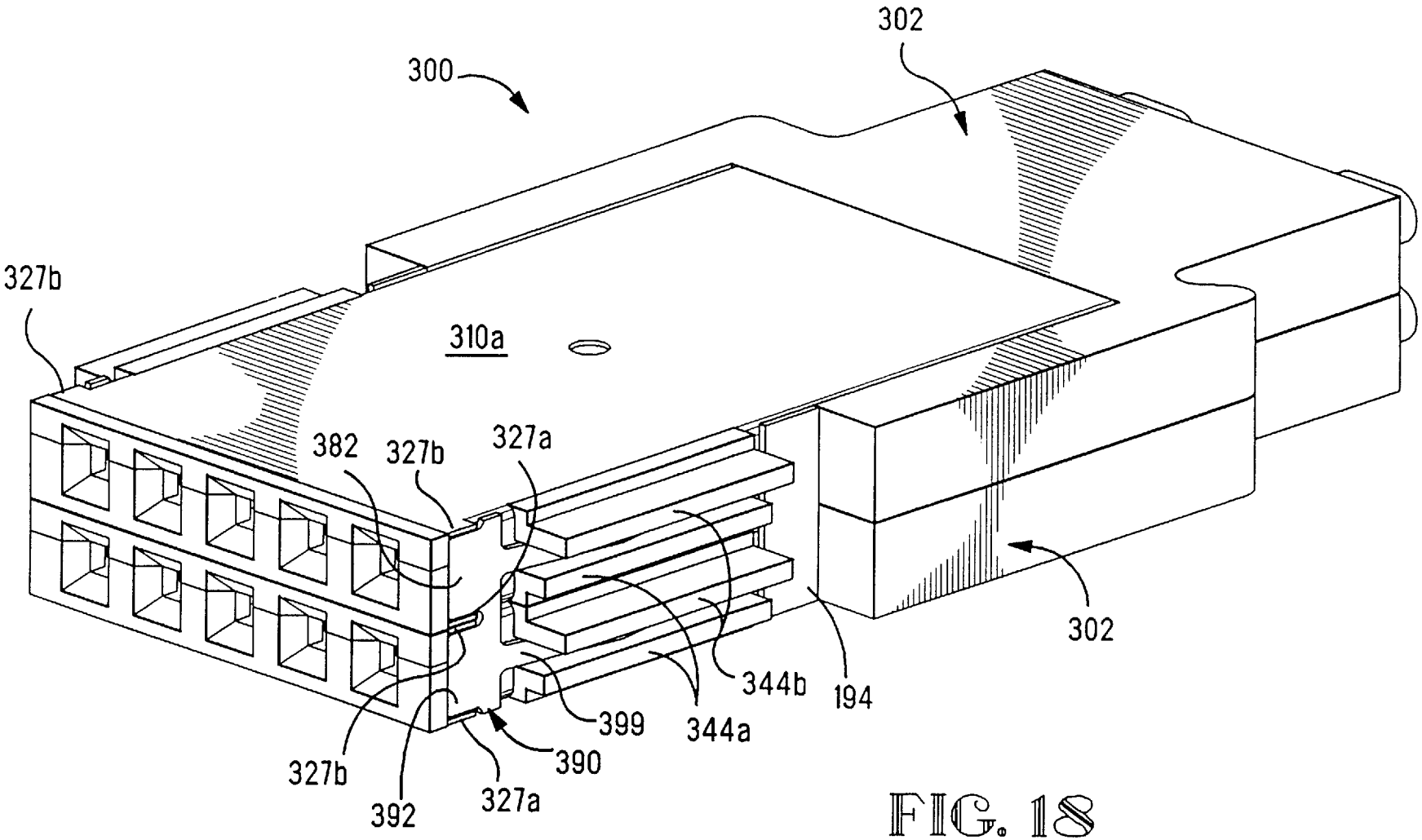

With reference now to FIGS. 17 and 18, another carrier strip 390 is presented. This alternative carrier strip 390 is of ladder-type configuration, having a front bar 392 constructed basically the same as carrier strip 380 of FIGS. 15 and 16 and which performs basically the same function. A rear bar 394 that is generally parallel to the front bar 392 and is spaced therefrom so that the front bar 392 is at the front of the rails 344*a,b* while the rear bar 394 is at the rear of the rails 344*a,b*. A contact rung 396 extends between the front bar 392 and the rear bar 394. These contact rungs 196 are constructed to fit between the rails 144*a*,144*b* when at least the front bar 392 is attached to the shields 310 of the connectors 302. The contact rungs 396 are bowed to space the bowed portion 399 away from the sides 322*a,b* of the shields 311*a,b* so that the bowed portion 399 may act as a contact surface for engaging a contact pin 358 of the header 350, as best seen in FIG. 14.

This configuration is especially useful for headers 350 incorporating a popular configuration that utilizes multiple seven pin terminal columns with the outer terminals 358*a* and the central terminal 358*b* being reference or ground terminals. In this application the central terminal 358*b* is received within the central port 333 to electrically engage the contact therein and the bowed surface 399 of the contact rungs 396 engages the respective outer terminal 358*a*, as best seen in FIG. 19. This configuration improves the reference, or grounding, of the connector 302 by providing two additional reference paths along the outer boundaries of each of the connectors 302, thereby enhancing the shielding characteristics of the connector 102, which is especially helpful with respect to high frequency applications that are EMI/RFI critical.

Especially advantageous is that the improved shielding characteristics can be achieved by the carrier strips 180,190 without effecting the basic size and configuration of the connector stack 100, thereby minimizing costs. Especially in the case of carrier strip 390, additional contact surfaces 399 are incorporated into the connector stack 300 without effecting the rails 144*a*,144*b* or their function.

Figure 20:
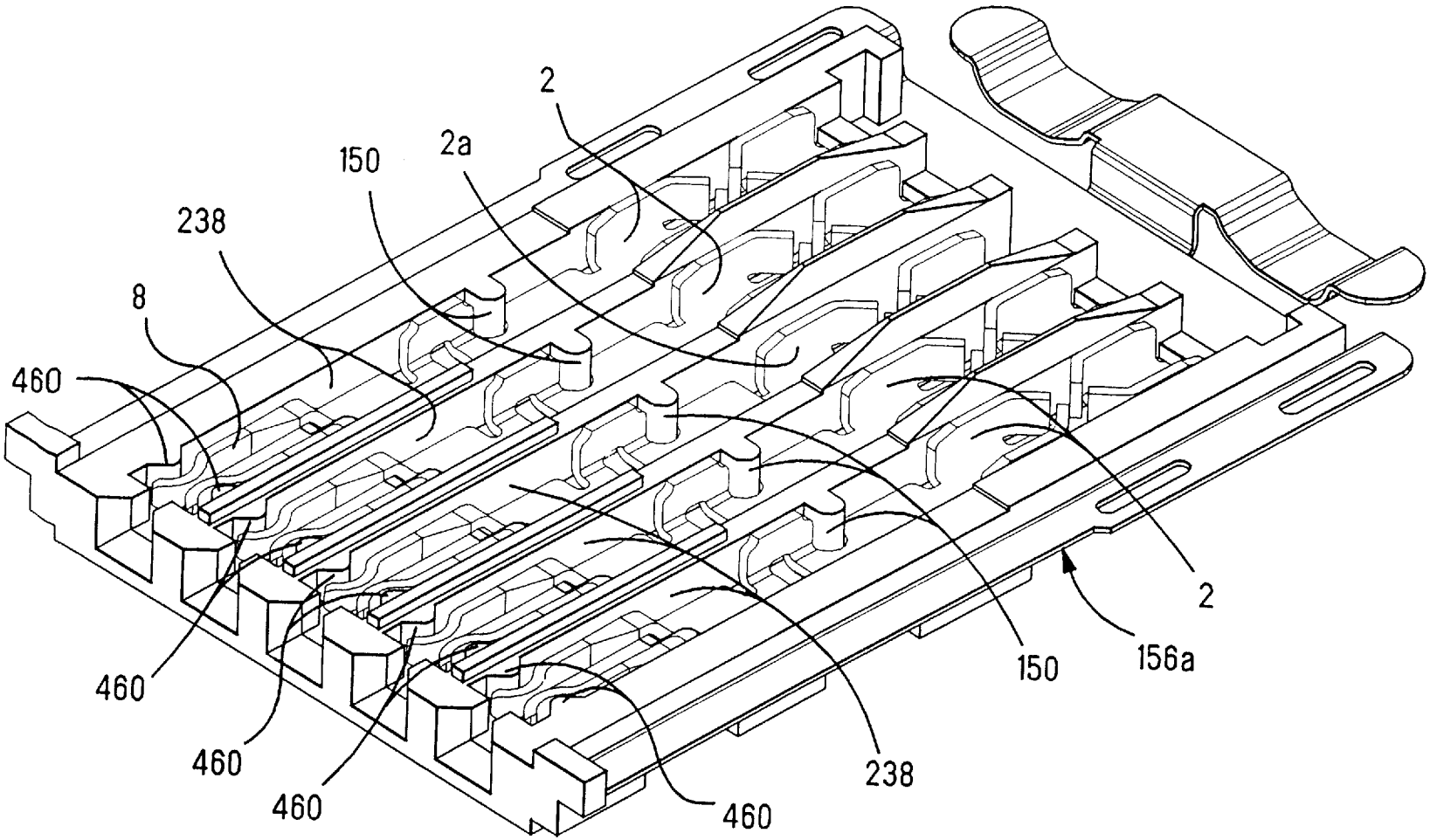
FIG. 20 is an perspective view of an improved housing to prevent damage to contact arms as a result of stubbing by a mating contact.

With reference now to FIG. 20, terminals, such as signal terminals 2 or grounding terminals 2*a*, are mounted in a channels 238 of a connector housing portion 156, as described in greater detail above with reference to FIGS. 5–12. The terminals 2,2*a* are maintained in position within the channel 238 at least in part by a post 150 that corresponds to a notch 148 in the terminal, as also seen with respect to FIG. 5. A support member 460 that prevents damage to the contact arms 8 from stubbing with a mating terminal is also incorporated along the forward end of the channel 452 at a location that generally corresponds to the inwardly converging and outwardly diverging portion of the contact arms 8, which is the semi-circular and designated 44 in FIG. 21.

With further reference to FIG. 21, the tab or pin contact 450 of the mating connector, possibly similar to that shown in FIG. 14, can enter the housing misaligned to such an extent as to "stub" against one of the contact arms 8. This "stubbing" occurs when the contact 50 comes into contact with one of the contact arms 8 in such a manner that the contact 450 does not slide along, and thereby deflect, the contact arm 8 to produce a wiping interconnection. In order to overcome the "stubbing", the terminal needs to be supported along the contact arms 8 as the pin or tab contact 450 is inserted to prevent the buckling of the terminal, enabling the stubbed condition to be overcome without damaging the contact arms 8 as the contact 50 and the terminal are interconnected.

The support member 460 is positioned within the channel 452 so that it can supportingly engage the region 44 on the back of the contact arms 8 in a manner that provides sufficient back-up to the diverging lead-in portion of the contact arms 8 to prevent buckling. The support member 460 is shown as being unitary with the walls of the channel 452 and having a generally triangular cross-sectional shape with a radiused peak. The support member 460 may take on any number of other shapes that could interact with the contact arms 8 in the desired manner by transferring the loading into the housing 54, rather than along the contact arms 8 and into the terminal where damage could occur in another part of the overall connector structure.

As the terminal is prevented from moving longitudinally within the channel 452 by the engagement of the post 150, continued insertion of the contact 50 causes the front portion 6 of the contact to deflect until the contact leg 8 comes into contact with the support member 460 positioned along the channel 52. As the lead-in portion 46 is now supported, the stubbing can be overcome as the insertion forces associated with mating are transferred into the housing containing the terminal. While this aspect of the invention has been described in relation to the terminals, housings and connectors according to the present invention, this should not be a limitation. The concept is easily transferable to other configurations.

Many modifications and variations may be made in the technics and structures described and illustrated herein without departing from the spirit and the scope of the present invention. Accordingly, it should be readily understood that the technics and structures described an illustrated herein are illustrative only, and are not to be considered as limitations upon the scope of the present invention.

We claim:

1. A shielded electrical connector (201;302) for shielded cable (234), the connector (302) comprising a conductive outer shield (156*a, b*;311*a,b*) surrounding an inner insulative housing (152;218) that is inmolded directly upon the conductive outer shield (156*a,b*;311*a,b*) and contains open ended channels (238) wherein similarly oriented electrical terminals (2;102) are positioned, characterized in that the eletrical connector (201;302) includes a housing portion (212;312) and a cover portion (214;310), each portion (212,214;312,310) including a portion of the conductive shield (156*a,b*;311*a,b*) and an inmolded portion (152, 218;316,318) of the inner housing at least one of the inmolded portions including a preformed portion of the channel.

2. The shielded electrical connector of claim 1, further characterized in that the electrical connector includes a housing portion and a cover portion, each portion including a portion of the conductive shield and an inmoulded portion of the inner housing.

3. The shielded electrical connector of claim 1 or claim 2, further characterized in that the conductive outer shell includes a port therethrough wherein a portion of the inmoulded insulative housing extends through the port.

4. The shielded electrical connector of claim 3, further characterized in that the portion of the insulative housing extending through the port is formed as a lug that is larger than the port, thereby captivating the conductive outer shell between the inner housing and the lug.

5. The shielded electrical connector of claim 3, further characterized in that the portion of the insulative housing extending through the port is formed as a rail.

6. The shielded electrical connector of claim 3, further characterized in that the portion that extends through the shield is formed as a guide member for aligning the shielded electrical connector therewith during mating.

7. The shielded electrical connector of claim 3, further characterized in that the portion that extends through the shield is formed as a keying member to assure proper orientation with respect to a mating connector.

8. The shielded electrical connector of claim 2, further characterized in that the portion of the inner housing that extends through the shield portion of the cover portion forms a distinct member from that of the portion of the inner housing of the housing portion.

9. The shielded electrical connector of claim 3, further characterized in that multiple shielded electrical connectors may be aligned to form a connector stack.

10. The connector stack of claim 9, further characterized in that the multiple shielded connectors are electrically interconnected.

11. The connector stack of claim 10, further characterized in that the multiple shielded connectors are electrically interconnected by a carrier strip extending along the shields.

12. The connector stack of claim 11, further characterized in that the carrier strip is formed in a ladder-type manner and having a contact strip extending along the side of the shielded connector for engaging a mating terminal.

13. The connector stack of claim 11 or claim 12, further characterized in that the shield of each connector includes spaced apart tabs that extend outward from the sides thereof and the carrier strip includes plates that are positioned between the tabs.

14. The shielded electrical connector of claim 1, further characterized in that the electrical terminals include a contact section that floats within the channel for alignment with the mating terminal.

15. The shielded electrical connector of claim 14, further characterized in that the contact section is interconnected to a rear conductor engaging section by an impedance compensation section wherein the inductance and/or the capacitance is tailored such that the connector is approximately invisible to the shielded cable.

16. The shielded electrical connector of claim 15, wherein the impedance compensation section also acts as a positional spring enabling the contact section to float relative the rear conductor engaging end.

17. The shielded electrical connector of claim 14, further characterized in that a support feature is included along the channel of the inner housing, such that as the contact section is deflected as a result of mating with a complementary contact, the contact section comes into supporting engagement with the support feature, whereby damage to the contact is prevented.

18. An electrical connector for establishing an eletrical connection with a contact (450) of mating device, comprising; a housing (156) having a channel (238) therethrough; a terminal **(2, 2*a*) mounted within the channel (238), said terminal (2,2*a*) having a contact portion (6) constructed to electrically engage the contact; said connector being characterized in that a support feature is (44) included along the contact portion (6) and a support member (460) is disposed along the channel (238) of the housing in a location in the vicinity of the support feature (44) of the terminal (2,2*a*) and configured to supportingly engage the support feature (44) during connection with the contact (450) of the mating device to limit the loading imposed on the terminal (2,2*a*) when the contact portion (6')** and the contact of the mating device are misaligned, whereby damage to the terminal because of stubbing between the contact portion and the contact of the mating device is prevented.

19. The electrical connector of claim 18, characterized in that said support feature is a concave recess along the contact portion of the terminal.

20. The electrical connector of claim 18 or 19, characterized in that the support member extends into the channel.

21. The electrical connector of claim 20, characterized in that the support member is unitarily formed with the channel.

22. The electrical connector of claim 18, characterized in that the terminal **(2,2*a*) is constructed that the contact portion (6) floats within the channel (238)**.

23. The electrical connector of claim 18, characterized in that the contact portion includes a deflectable beam contact arm that electrically engages the contact.

24. The electrical connector of claim 22, characterized in that the support member engages the support feature upon deflection of the contact portion due to connection with the contact.

25. An electrical contact comprising a front contact portion having opposing spring arms defining a contact region therebetween for receiving a mating pin, a rear conductor engaging portion and a compliant middle portion therebetween where the compliant middle portion is a planar incompressible meander that enables the contact portion to be deflectable to align with the mating pin.

26. The contact of claim 25 wherein the meander defines an opening for retaining the contact in position in a housing.

27. The contact of claim 25, wherein the opposing spring arms are joined to the serpentine section through a stepped portion.

28. The contact of claim 25, wherein the contact arms include a twist thorough ninty degrees.

29. The contact of claim 25, wherein the contact includes a plate-like extension between the front contact portion and the rear conductor engaging portion having a closed boundary opening formed therein.

30. The contact of claim 25, wherein the rear conductor portion is connected to the compliant portion through a stepped portion.

31. The electrical connector of claim 18, characterized in that the contact portion includes a forwardly cantilevered deflectable beam contact arm extending to a free end and having a contact surface on one side of a curved portion for electrically engaging the contact of the mating device, where the support feature is a concave recess disposed on the other side of the curved portion, the support member being located along the channel.

* * * * *